US007941985B2

(12) United States Patent
Simmons

(10) Patent No.: US 7,941,985 B2
(45) Date of Patent: May 17, 2011

(54) HALO/SPIDER, FULL-MOMENT, COLUMN/BEAM CONNECTION IN A BUILDING FRAME

(75) Inventor: Robert J. Simmons, Hayward, CA (US)

(73) Assignee: ConXtech, Inc., Hayward, CA (US)

( * ) Notice: Subject to any disclaimer, the term of this patent is extended or adjusted under 35 U.S.C. 154(b) by 411 days.

(21) Appl. No.: 12/156,252

(22) Filed: May 30, 2008

(65) Prior Publication Data

US 2008/0295443 A1 Dec. 4, 2008

Related U.S. Application Data

(60) Provisional application No. 60/932,486, filed on May 30, 2007.

(51) Int. Cl.
*E04H 12/00* (2006.01)

(52) U.S. Cl. ..... 52/655.1; 52/854

(58) Field of Classification Search ..... 52/655.1, 52/854; 403/252–255, 331
See application file for complete search history.

(56) References Cited

U.S. PATENT DOCUMENTS 2,008,087 A * 7/1935 Stromberg ..... 403/189
4,018,057 A 4/1977 Erzen et al.
4,019,298 A * 4/1977 Johnson, IV ..... 52/590.1
5,244,300 A * 9/1993 Perreira et al. ..... 403/381
5,289,665 A 3/1994 Higgins
5,678,375 A 10/1997 Juola
6,082,070 A 7/2000 Jen
6,092,347 A 7/2000 Hou
6,837,016 B2 1/2005 Simmons et al.
2006/0110215 A1* 5/2006 Holscher ..... 403/253

FOREIGN PATENT DOCUMENTS

GB 1204327 9/1970
WO WO 98/36134 8/1998

* cited by examiner

*Primary Examiner* — Jeanette E Chapman
*Assistant Examiner* — Daniel Kenny
(74) *Attorney, Agent, or Firm* — Jon M. Dickinson, Esq.; Robert D. Varitz, Esq.

(57) ABSTRACT

A column/beam connection in a building frame, including an elongate column having faces which join through corners, an elongate beam having an end, and a full-moment nodal connection connecting the end of the beam to the column solely through a pair of next-adjacent corners in the column, with the beam end, as so connected, being spaced from the column face which lies between the mentioned pair of corners. The connection per se features (a) plural standoffs joined to and extending, one each, outwardly from the column's corners at a selected, common elevation located along the length of the column, and (b) a halo collar joined through a gravity-seat-and-lock, full-moment interface connection to each of the standoffs, and, as so joined, spaced by the standoffs from the column faces which lie between the column corners.

9 Claims, 4 Drawing Sheets

Fig. 3
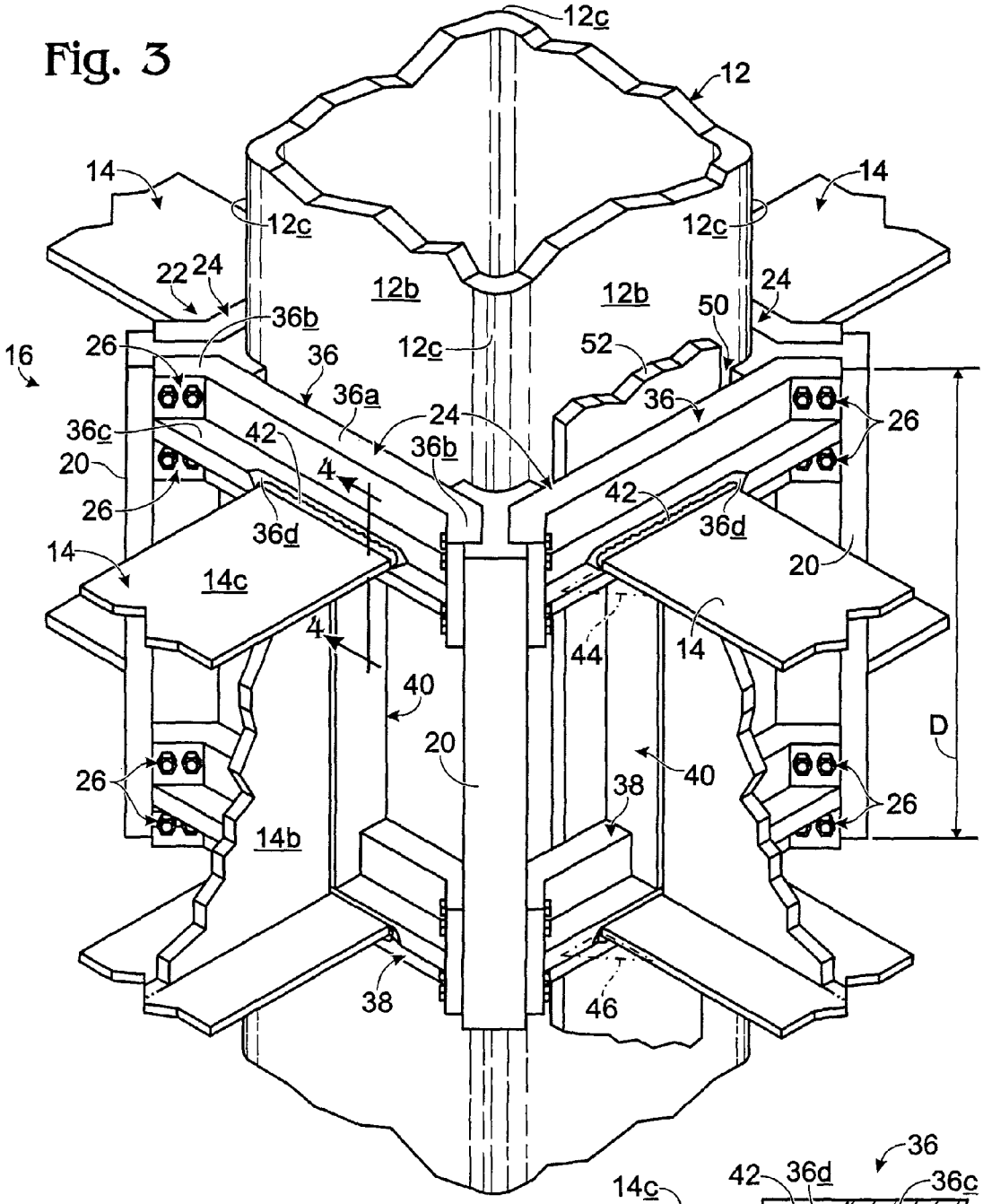
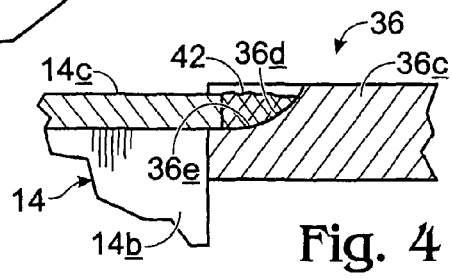
Fig. 4

Fig. 6
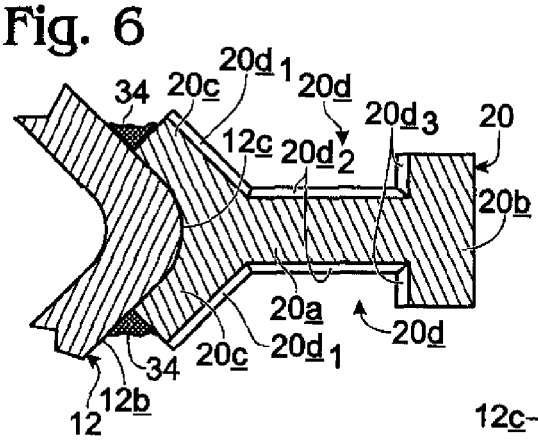
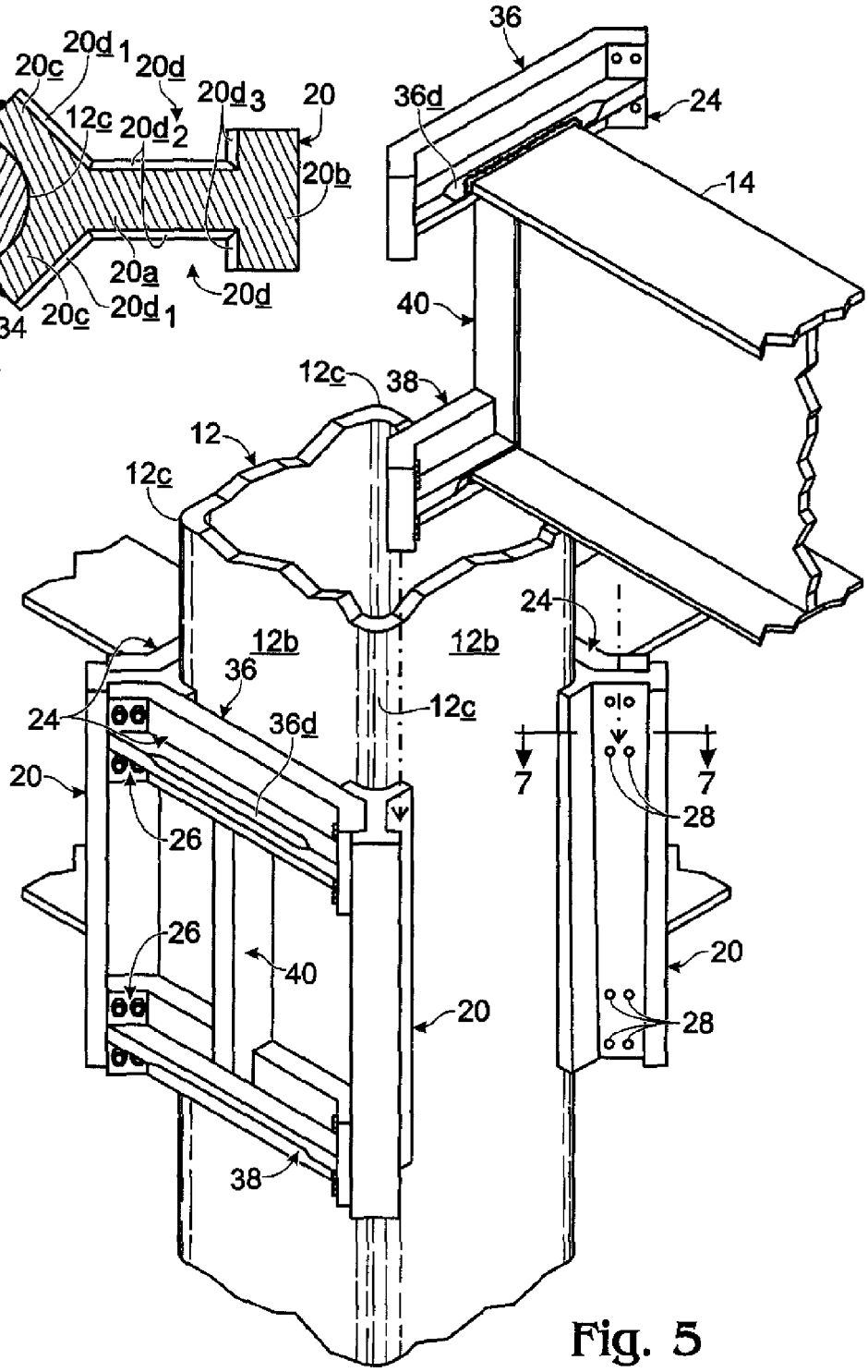
Fig. 5

HALO/SPIDER, FULL-MOMENT, COLUMN/BEAM CONNECTION IN A BUILDING FRAME

CROSS REFERENCE TO RELATED APPLICATION

This application claims priority to the filing date, May 30, 2007, of U.S. Provisional Patent Application Ser. No. 60/932,486, covering an invention titled "Halo/Spider, Full-Moment, Column/Beam Connection in a Building Frame". The entire disclosure content of that prior-filed provisional case is herb incorporated herein by reference.

BACKGROUND AND SUMMARY OF THE INVENTION

U.S. Pat. No. 6,837,016 describes an extremely successful and important full-moment, collar-form, nodal connection between a column and a beam in the frame of a steel frame building structure. This nodal connection, now in use in a number of building structures in various locations particularly where high seismic activity is experienced, offers a number of very important advantages over prior art column/beam nodal connections. The connection is one which may readily be prepared in an off-building-site manner within the realm of a factory for precision computer control and accuracy, and additionally, one which has a number of important field-assembly speed and safety advantages not present in or offered by prior art nodal connection arrangements. For example, no non-disconnectable welding needs to take place irreversibly locking a column and a beam, and beams may be lowered by gravity quickly into place to become immediately, by gravity lowering alone, seated in proper spatial orientation relative to the columns with they are associated, and with the result that a full seismic-capable moment connection exists at the very moment that gravity seating and locking take place during a beam-lowering operation.

While this prior-developed nodal connection structure has met with a great deal of acclaim and success, I have recognized that there is room for improvement in certain respects, and the nodal connection proposed by the present invention specifically addresses that improvement-need recognition.

Among the advances offered by the present invention are an improvement in the way that a resulting nodal connection handles certain kinds of loads, such as prying loads, and additionally that the new connection's modified components possess a certain quality of structural universality which enables the manufacture of just a few different components to offer the possibility for applying these components easily to building-frame beams having different web depths within a range of conventional beam-web depths.

As those skilled in the art will recognize on viewing the drawing figures in this case, and on reading the detailed description of the invention which is presented below, the structure presented by this invention offers a number of other interesting and important features and advantages which are relevant to the fabrication and performance of a multi-story steel building frame.

Accordingly, proposed by the present invention is a unique, collar-form, full-moment nodal connection which is referred to herein as a halo/spider connection. This "halo/spider" reference addresses certain visual qualities of the proposed connection which include the fact that, in its collar-form arrangement, (a) it includes an outer collar to which the ends of beams may be attached, which collar appears to float as a circumsurrounding, and somewhat spaced, halo around the perimeter of the cross-section of an associated beam, and (b) that this halo collar is anchored through gravity-lock seating to the outside of a column via outwardly extending standoffs (like legs) which extend from the corners of a column in a fashion which suggests, as this arrangement is viewed along the axis of a column, the anatomy of a spider body with short legs.

With respect to the opportunity provided by the structure of the present invention to handle different beam depths, the design of the structure of this invention is such that there are simply two, different, specific components/elements that are employed in the halo/spider organization which need only to be cross-divided, separated, and then reunited in a spaced-apart condition through "extender structure" in order to permit employment of all the nodal connection components successfully with beams having different depths lying within the conventionally (today) recognized range of beam depths that define steel building frame structures employed in different settings and for buildings of different sizes and designs.

These and other features and advantages which are offered by the invention will become more fully apparent as the description thereof which follows in detail below is now read in conjunction with the accompanying drawings.

DESCRIPTIONS OF THE DRAWINGS

FIG. 3 is still a larger-scale, fragmentary and isometric view illustrating portions of one of the nodal connections pictured in FIGS. 1 and 2, with certain component portions broken away to reveal details of construction.

FIG. 4 is an even yet larger-scale, fragmentary, cross-sectional view taken generally along the line 4-4 in FIG. 3, illustrating a weld preparation, and a welded connection which exists between the end of a beam, and what is referred to herein as a beam-end connecting component.

FIG. 5 is a view presented from about the same point of view which is seen in FIG. 3, specifically illustrating the action of gravity seating and locking of a beam-end connecting component to produce automatically, and without more activity, a full-moment interfacial connection between a beam and portions of what is called herein a spider dock structure anchored to the outside of the illustrated column.

FIG. 6, which is drawn on a larger scale than that employed in FIG. 5, illustrates, in a fragmentary, cross-sectional and isolated manner, one of the standoffs proposed by the present invention attached to the column shown in FIG. 5 to form a portion of the spider dock structure of the present invention.

Figure 7:
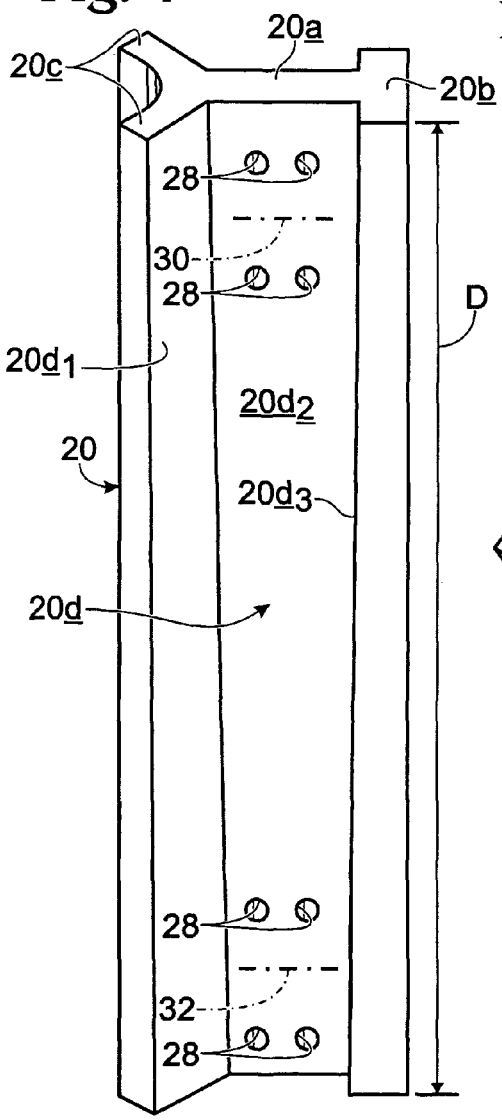

FIG. 7 is an isometric, lateral elevation showing details of the standoff illustrated in cross section in FIG. 6.

Figure 8:
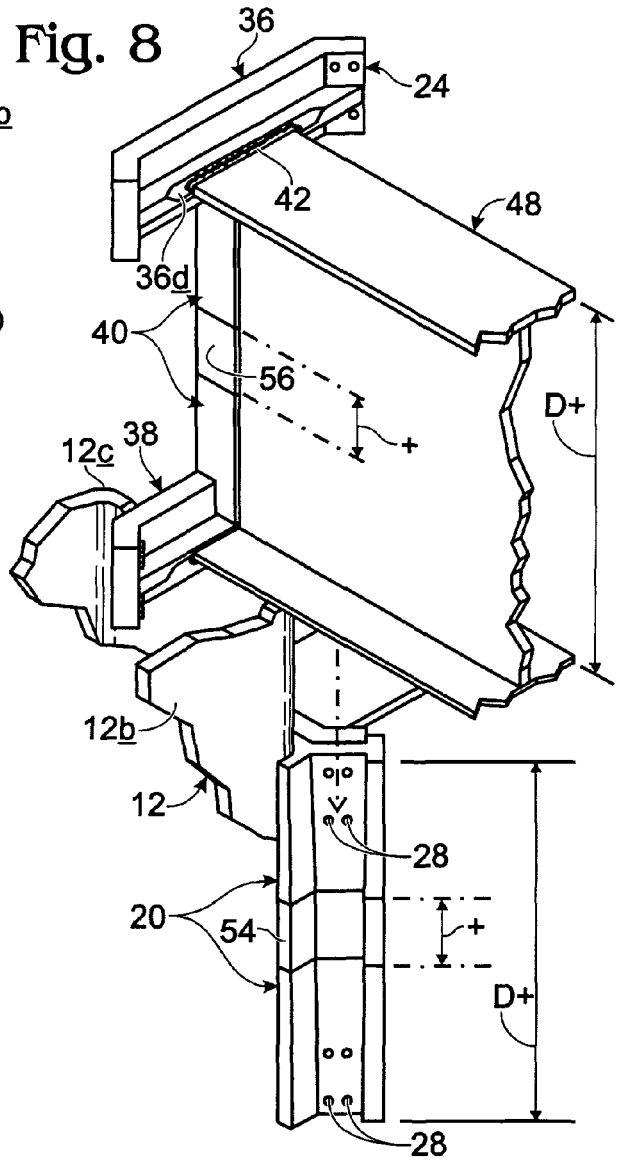

FIG. 8 is similar to a portion of FIG. 5, but here shows sizing adjustments which have been made in a pair of components/elements in the invention to accommodate adaptation to an I-beam whose web depth is greater than that of the beam shown in FIGS. 1-5, inclusive.

DETAILED DESCRIPTION OF THE INVENTION

Figure 1:
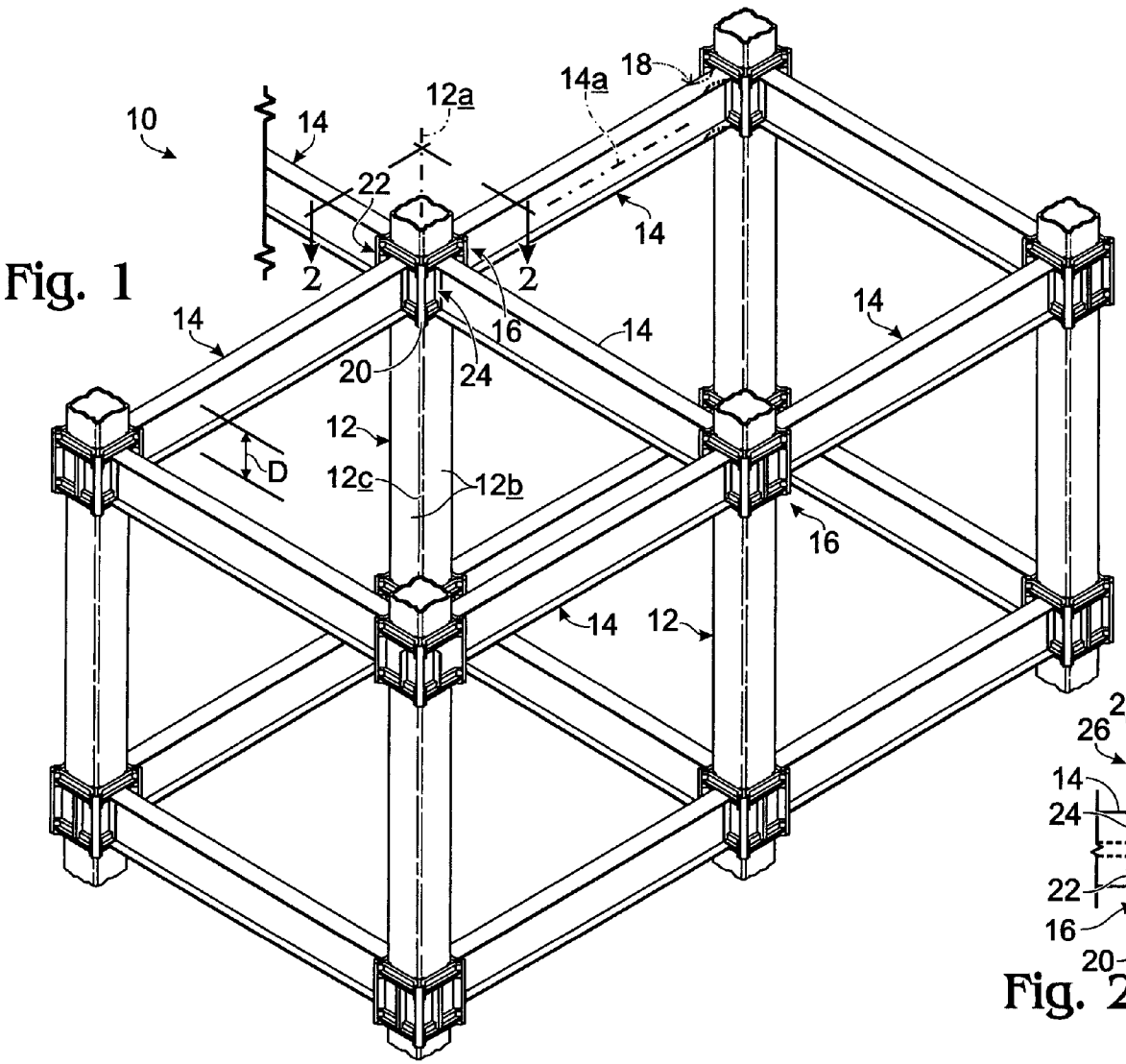
FIG. 1 is a fragmentary, isometric view of a plural-story, steel, building frame possessing interconnected columns and beams whose interconnections take place through collar-form, full-moment, gravity-seat-and-lock nodal interface connections constructed in accordance with a preferred and best-mode embodiment of the present invention.
Figure 2:
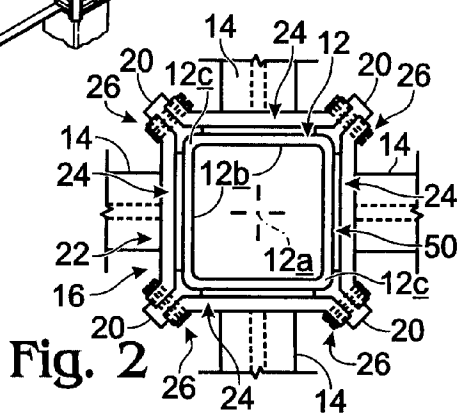
FIG. 2 is a somewhat larger-scale, fragmentary view looking downwardly along the axis of a single column in the building frame of FIG. 1, designed to illustrate what has been referred to above as the halo/spider general visual configuration of the nodal connection of this invention.

Turning now to the drawings, and referring first of all to FIGS. 1 and 2, indicated generally at 10 in FIG. 1 is a fragmentary portion of a plural-story steel building frame including columns 12 which are interconnected by elongate I-beams 14 through nodal connections 16 which have been constructed in accordance with a preferred and best-mode embodiment of the present invention. Columns 12 include long axes, such as long axis 12*a,* and four, generally planar sides, or faces, such as faces 12*b,* which join through four, slightly radiused column corners, such as corners 12*c.*

While different kinds of columns may be addressed in the practice and implementation of the present invention, columns 12 herein have generally square cross sections, with the result that faces 12*b* orthogonally intersect one another through corners 12*c.*

In frame structure 10, beams 14 extend substantially horizontally between pairs of next-adjacent columns, and have long axes, such as axis 14*a,* which orthogonally intersect column axes 12*a.* It is specifically the opposite ends of each beam 14 which are connected to a pair of next-adjacent columns through nodal connections 16.

Illustrated in dashed lines at 18 and at one location in frame fragment 10, with respect to one of beams 14, is an optional fuse which, if desired in a particular building frame structure, may be formed in the upper and lower flanges of a beam, typically relatively near to one or both of that beam's opposite ends. This fuse is illustrated herein merely for background information, and forms no part of the present invention.

The beams specifically illustrated in the building frame which is now being described each has an overall beam depth, determined principally by the central upright webs therein, illustrated at D. A reason for pointing out this dimension will become more fully apparent later in relation to discussing the adaptability of the invention to different beam depths (or heights, or vertical dimensions).

With respect to the structural components so far described, there is a range of terminology which is employed herein with respect to certain ones of these components. For example, each nodal connection 16 is also referred to herein (a) as a building frame node, (b) as a full-moment, gravity-seat-and lock halo/spider connection, (c) as a beam/column nodal connection, (d) as a column/beam connection, and (e) as a full-moment, standoff-collar, column/beam nodal connection.

As will become more fully apparent later in this detailed description of the invention, each nodal connection 16 is formed (a) by certain components which are attached directly by welding to the corners in columns 12, and (b) by certain beam-end connecting components which are attached by welding to the opposite ends of beams 14. These two kinds of connection components are designed in such a fashion that, during frame assembly, and after placement of next-adjacent columns at their proper locations, properly prepared end-readied beams are simply lowered by gravity into place between pairs of next-adjacent columns, whereby the nodal-connection components of the invention effectively engage by gravity through male and female tapered bearing structures, which engagement causes, with continued lowering of a beam, that beam to seat in a gravity-locked, full-moment condition at the region of connection with a column. At that very point in time, such full-moment gravity seating automatically causes the associated column and beam to assume their correct spatial positions in accordance with building frame design.

The nodal-connection componentry of the present invention is precision-made structure, typically formed under computer-controlled factory conditions, whereby all of the fabrication and assembly conveniences, features and advantages which are described for the mentioned, predecessor full-moment connection described in the above-referred-to U.S. Patent are also present in the structure of the present invention.

As will shortly be seen, the present nodal connection structure, in addition to offering all of the advantages of the mentioned predecessor structure, additionally offers other features and advantages which put it in the category of being truly an improved full-moment nodal connection between a column and a beam.

The term "halo/spider", and the individual terms "halo" and "spider", have been chosen herein for descriptive purposes in order to highlight a certain interesting visual characteristic of each nodal connection 16. According, if one will simply turn attention to the view presented in FIG. 2 of a nodal connection 16, the "spider" visual aspect of connection 16 is furnished by the presence of four standoffs 20 which are anchored to the illustrated column 12 by welding, and which extend angularly outwardly from the four corners in that column at angles which are essentially 135-degrees with respect to the associated, two, intersecting column faces 12*b* which join at the corners 12*c* from which the standoffs extend. These standoffs visually suggest the legs of a spider, particularly when viewed in the context of extending outwardly, as seen, from the corners of the square cross section of a column 12. Standoffs 20, in next-adjacent pairs, and also as a whole herein, define what is referred to as a standoff spider dock.

The halo terminology has been employed herein to reflect the visual, floating, halo-like quality of a nodal-connection collar 22—a collar which is also referred to herein as a halo collar, as a standoff collar, and as a column-surround collar which spatially circumsurrounds the perimeter of the cross-section of each column 12 where the collar is located.

In a more specific sense, each halo collar, which, as can be seen relatively clearly in FIG. 2 appears to float in an outwardly spaced condition relative to the sides and corners of the column 12 which is shown in this figure, is formed as a segmented structure, based upon an organization of four, beam-specific coupling entities 24 which are also referred to herein as beam-end connecting components. As will be more fully explained, each beam-end connecting component 24 is welded to the appropriately prepared end of a beam 14. The concept "appropriately prepared" will be described more fully shortly. Additionally, the spaced condition just mentioned makes an important contribution to the advantages offered by the present invention, and this contribution will also be discussed shortly.

Saying a bit more here about beam depth D, the components of the invention illustrated in the drawings so far discussed herein in the detailed description of the invention have been designed nominally for what is considered to be a minimum beam depth of about 14-inches, which is specifically the dimension D shown in the drawings. In conventional, steel-frame, I-beam technology, from this minimum beam-depth dimension, up to a beam depth of about 18-inches, traditionally available beam depths typically increment in intervals of 2-inches. Above a conventional beam depth of 18-inches, beam depths typically increase in increments of 3-inches.

One of the features of the present invention, stated generally earlier herein, involves what might be thought of as somewhat universal qualities of certain components/elements in nodal connection 16, and specifically in standoffs 20 and beam-end connecting components 24. These pseudo-universal qualities enable, quite easily, the overall vertical heights of these components/elements to be lengthened through the incorporation of lengthening inserts, as will be described, in order to adapt the nodal-connection hardware of the present invention to handle, readily, any one of the conventional, wide variety of available beam depths greater than the minimum beam depth D which happens to be pictured herein. More will be said about this "universality" beam-depth-accommodating feature a bit later in this detailed description of the invention.

The corners of halo collar 22 in each nodal connection 16, which corners are defined by the lateral sides of beam-end connecting components 24, are anchored to standoffs 20 in the standoff spider dock by four pairs, at each corner, of vertically spaced nut-and-bolt sets, such as those shown very generally at 26. In particular, and regarding the four pairs of such nut-and-bolt sets which are associated with each collar corner, the two of these pairs which are uppermost vertically flank, or bracket, the plane of the upper flange in each adjacent, attached beam end, and the two pairs which are lowermost vertically flank, or bracket, the plane of the lower flange in such beam ends. More will be said about the importance of this structural nut-and-bolt-set flanking/bracketing arrangement shortly. Nut-and-bolt sets 26 are also referred to herein as tension pre-stress structure.

Considering now FIGS. 3-7, inclusive, along with already discussed FIGS. 1 and 2 in the drawings, and discussing further the details of construction of the components which make up each nodal connection 16, standoffs 20 are elongate elements having the configuration which is probably most clearly illustrated in FIGS. 6 and 7 in the drawings. These standoffs, as illustrated herein, have an overall height which is the same dimension D as the overall vertical dimension D of beams 14. In this context, each standoff 20 is a singular, individual component, whose cross-section includes a main, planar body portion 20*a,* which is the portion that extends at the angles mentioned earlier herein outwardly from the corners of a column. The outer, elongate edge of each of these planar body portions is "T-capped" by a capping structure 20*b,* and the inner, elongate edge of the same main body portion terminates in a Y-formed structure which includes two, orthogonally intersecting feet 20*c* whose inside region of intersection is appropriately radiused in a manner which preferably matches the radius of the outsides of corners 12*c* in columns 12.

Formed on opposite sides of each planar body portion 20*a* are two, elongate, generally vertically extending, three-sided, angle-walled, downwardly and inwardly commonly tapered channels 20*d* whose dimensions are, accordingly, larger near the upper ends of standoffs 20 than at the lower ends of the standoffs. The three channel walls, or sides, which make up each one of these channels, are shown at $\mathbf{20}d_1$, $\mathbf{20}d_2$ and $\mathbf{20}d_3$. With respect to the common taper in these walls, with a standoff anchored in place to the corner of an upright column, the walls are angled relative to the vertical by an angle of about 5-degrees.

Four pairs of side-by-side bolt holes which accommodate the shanks of the bolts in nut-and-bolt sets 26 are shown for a few of these bolt holes at 28 in FIG. 7. The upper and lower pairs of bolt holes pictured in FIG. 7 generally equally vertically straddle a horizontal plane which is represented by a dash-dot line 30 in FIG. 7. Similarly, the upper and lower pairs of bolt holes 28 which are disposed near the lower end of each standoff 20 generally equally vertically straddle a plane which is represented in FIG. 7 by a dash-dot line 32. As will be more fully explained shortly, when a nodal connection is in place uniting a beam and a column in frame 10, the upper and lower flanges of the associated beams essentially lie in the planes which are represented by dash-dot lines 30, 32.

Standoffs 20 are appropriately secured through their feet 20*c* to the corners of a column 12 through welds, such as the two, elongate welds shown as darkened regions 34 in FIG. 6. Feet 20*c* effectively "wrap around" a column corner 12*c*.

Opposing pairs of channels 20*d* which obliquely confront one another across a face 12*b* in a column 12, define and constitute what is referred to herein as a female-tapered bearing-interface structure, or socket, in the spider dock created by standoffs 20. It is this female-tapered bearing-interface structure which, when a beam is lowered to proper position relative to a column, defines a complementary gravity-seating reception region for the male-tapered bearing-interface structure (still to be described) which exists in each beam-end connecting component.

Continuing with the description of each nodal connection, each beam-end connecting component 24 has fundamentally three elements, including an upper transverse element 36, a similar, spaced lower transverse element 38, and a centrally welded, intervening and interconnecting bridging element 40. The upper and lower transverse elements collectively form what is referred to herein as a transverse component. Where the beam height, or vertical depth, which is to be accommodated by a nodal connection as D is illustrated herein, essentially bridging element 40 in each beam-end connecting component is given an interconnecting length, so-to-speak, which will determine that the overall height of the beam-end connecting component will have a matching vertical dimension D.

Recognizing that each of the two transverse elements just mentioned are essentially the same in construction, a more detailed description of one of these elements will suffice to describe the other element. Accordingly, and providing such description in conjunction with upper transverse element 36, this element includes an elongate, central, generally planar expanse 36*a* which joins at its ends with two, angular end wings 36*b* which are also planar, and which extend in planes that lie at angles of about 135-degrees relative to the plane of central expanse 36*a*. On the sides of the transverse elements which are intended to face the end of an attached beam, there exists an elongate shelf, such as shelf 36*c,* which furnishes an appropriately disposed central weld preparation 36*d* intended to receive the slightly longitudinally extending beam-end flange portion of an attached beam which has been created in a beam end in order to enable proper weld attaching of that beam end to the associated beam-end connecting component. In the upper transverse element in a beam-end connecting component the weld preparation just mentioned is upwardly facing, and in the lower, associated transverse element, the relevant weld preparation is downwardly facing.

FIG. 4 in the drawings illustrates what was referred to earlier as an appropriately prepared end of a beam 14, wherein one can see that the beam's central web 14*b* has been cut to become recessed so as to allow for a slight longitudinal extension beyond that web of the end of an upper flange 14*c* which is seen to overlie an appropriate platform, or shoulder, 36*e* that is provided in illustrated weld preparation 36*d*. In FIG. 4, reference numeral 42 illustrates a weld which has been prepared in the illustrated weld preparation to unite transverse element 36 to the beam end shown in FIG. 4. It will be understood that the entirety of the end of a beam is welded all around to appropriate confronting surfaces in a beam-end component.

With regard to a further important set of structural features relating to the upper and lower transverse elements in each beam-end connecting component, surfaces in these elements which are associated with, and are near, the element's wings, such as wings 36*b,* are formed with vertically aligned tapers that effectively complementarily match, even though the upper and lower transverse elements are vertically spaced, the tapers which exist in walls 20$d_1$, 20$d_2$, 20$d_3$ in standoffs 20. These tapered portions in the transverse elements constitute the earlier-mentioned male-tapered bearing-interface structures.

A result of this male-female tapered geometry now fully described is that, during the process of beam-column connecting via a nodal connection 16, a precision-tapered locking fit will be established between a beam-end connecting component and pair of adjacent standoffs, thereby establishing the important gravity-seating-and-locking, full-moment nodal connection which is established in accordance with the construction of the present invention. This geometric arrangement obviously allows a beam with a beam-end connecting component welded to its ends to be lowered into proper position for connection to and between a pair of columns, with the associated beam-end connecting components bottoming out through engagements of the confronting, male-tapered and female-tapered bearing-interface surfaces. Precision control of dimensioning which is entirely possible with the structure of this invention, as indicated earlier, results not only in a full-moment connection developing immediately upon such tapered bearing surface bottoming out, but also results in exact spatial positioning of a beam relative to a column. The resulting tapered bearing interface which exists is also referred to herein as a non-welded, disconnectable interface. This reference points out that there is no irreversible weld connection positively locking a beam to a column.

FIG. 5 in the drawings is presented in a fashion intended to illustrate such vertical lowering and seating capability and action. FIG. 5 also illustrates another feature of the invention which relates to a condition where less than four beams are attached to a column, and even more specifically, to a condition where even just one side of a column has no beam attached to it. Where this is the case, the structure of a halo collar, which is finished as a full collar wherever a nodal connection 16 of any nature is present, is essentially completed by the presence of a full, or partial (to be explained), beam-end connecting component, without that component having any association whatsoever directly with a connected beam end. This condition for one portion of the halo collar pictured in FIG. 5 is clearly illustrated, where the near, fully shown, and full, beam-end connecting component 24 can be seen to be engaged with a pair of standoffs 20, but not directly connected to any associated beam.

While FIG. 5 illustrates a condition where a full beam-end connecting component is so utilized where no beam is present, it is also possible for the completion of a halo collar under these circumstances to be accomplished simply through the use of only the upper and the lower beam-end connecting component transverse elements, without the presence of any intervening bridging component 40. Such an arrangement, which is not specifically pictured herein, constitutes what was just referred to above as a partial beam-end connecting component.

When all gravity seating and locking activity has taken place with respect to the establishment of a nodal connection 16, with the resulting completion of a column-circumsurrounding halo collar, as well as the full establishment of appropriate, full-moment connections, nut-and-bolt sets 26 are installed and tightened to place the shanks of the bolts in appropriate pre-stress tension. As was mentioned earlier, upper and lower groups of pairs of these nut-and-bolt sets vertically straddle the planes of the flanges of an attached beam, which flange planes are shown at 44, 46 for the upper and lower flanges, respectively, of one of the beams pictured in FIG. 3. The importance of this arrangement is that such nut-and-bolt-set flange-straddling placements greatly enhance the anti-prying failure resistance of a beam and column connection, as proposed herein, because of the fact that forces transmitted from a beam through a nodal connection 16 to a column are bracketed by these nut-and-bolt sets at the points of force application through the halo spider structure of the invention.

From what has been described so far, and illustrated in the drawings, one will appreciate that a special and unique feature of the present invention is that moment loads between a beam and a column are transmitted from the beam to the column solely through the corners of the collar structures and the corners of the column. These loads, with respect to each corner where such a load is conveyed from beam to column, are carried through and appropriately managed by all of the welds associated with an involved standoff. In other words, all welds which bond a standoff to and around the corner of a column play a role in managing beam-to-column delivered loads. This constitutes a decided advantage, and an important feature, in full-moment load-handling as provided by the nodal connection structure of this invention.

Returning attention now to the previously mentioned spaced condition, or space, which exists between the transverse elements in each beam-end connecting component and a face 12*b* in a column 12, such a space is shown at 50 in FIGS. 2 and 3. This vertically elongate space uniquely accommodates clearance for the attachment, by welding for example, of an auxiliary column-stiffening plate, such as the stiffening plate shown fragmentarily at 52 in FIG. 3 which is seen to extent in reverse, or opposite, vertical directions away from space 50, at locations in a building frame where such auxiliary column stiffening might be desired. Especially important to note is that attachment of such auxiliary structure in no way interferes with the structure or integrity of a full-moment nodal connection 16.

Another one of the important and unique features of the present invention is that certain components in the nodal-connection structure are designed to allow for a change in the sizing of components in order to accommodate, within a normal construction range, beam depths, or overall beam vertical heights, which are greater than dimension D. FIG. 8 in the drawings helps to explain this invention feature.

In this figure there is illustrated fragmentarily an end of a beam 48 which has a depth D+ which is greater by some amount (+) than the dimension D previously described. In accordance with the invention, all that is required to accommodate this new beam depth is for the relevant standoffs and bridging elements, 20, 40, respectively, to be cross-cut, typically midway between their opposite ends, and to have inserts, such as those shown at 54, 56, respectively, welded in place to extend the lengths of these components by the amount of the (+) increase in vertical dimension dictated by beam height D+.

With respect to insert 56 in a bridging element 40, it will typically be the case that this insert will have the same cross-sectional dimension as that of the bridging element per se.

In the case of each standoff, which, in the absence of being cut apart to accommodate a length-increasing insert, has a nominally continuous taper in its channels 20*d*, the insert provided will have no tapered surface in it at all, but specifically will have a cross-sectional configuration which exactly matches the cross section of the standoff where the cross-cut to accommodate the insert has been made.

With such inserting accomplished to achieve greater-length standoffs and greater-height beam-end connecting components, such modified nodal-connection structures 16 will function in precisely the same manner as previously described with respect to furnishing full-moment, precision, gravity-seat-and-lock connections between beams and columns. Nothing else need change in the nodal connection structure in order to accomplish this accommodation, and the accommodation per se will in no way affect all of the other important performance and operational features which have been described for nodal connections 16.

The present invention thus offers an interesting and useful operational improvement over prior full-moment connection structures, such as that structure which is described in the above-referenced U.S. Patent. It does so by proposing and offering what has been referred to herein as a halo collar—a segmented structure to which one or more beams are anchored through the individual segments in the collar referred to as beam-end connecting components. This halo collar, formed as is with the mentioned segment components that are beam-end specific components is, during use, lowered, in a segment-by-segment manner, and in a gravity-urged, gravity-ultimate-locking fashion, into what has been referred to and described herein as a receiving standoff dock, the so-called spider dock, which takes the form of, and which is defined by, outwardly projecting standoffs that extend angularly outwardly from the typical four corners in the usual steel building frame column. This dock, in collaboration with the beam-end connecting components, is complementarily configured, in a male-female tapered, bearing-surface manner, to support the halo collar and attached beams in full-moment load-handling conditions in relation to connected-to columns.

The halo collar, when in place received by a standoff spider dock, circumsurrounds and is spaced from the outer sides of an associated column, with the spaces that exist between the beam-end connecting components and the faces of an associated column affording completely free clearance space for the installation of elongate auxiliary column attachments which might be employed, where desired, to provide greater stiffness for columns in a certain locations in a building frame.

As has just been described immediately above, the components, or certain ones of them, which make up the halo collar and the spider dock are designed in such a fashion that, during fabrication and pre-construction of beams and columns, vertical design repositioning of certain components is uniquely permitted in order to accommodate the attachment (to a column) of beams having different beam web depths. In other words, components which make up the halo collar and the standoff spider dock are characterized by vertically spaced elements whose relative vertical positions become defined at the time of fabrication so as to enable very convenient, efficient and relatively low-cost preparations of columns to receive beams with different web depths. This accommodation to deal with different beam depths is made possible without the requirement for redesigning the important gravity-lock male and female tapers which play pivotal roles in the practice of gravity-establishing a full-moment connection between a column and a beam, and also establishing simultaneously occurring full and accurate correct relative positioning of beams and columns.

Moment loads which are transmitted from a beam to a column are communicated uniquely to the column (a) through the corners in the halo collar and in the standoffs, and to the corners, rather than directly to the faces, of a column. The presence of the mentioned tensioning nut-and-bolt sets, deployed as they are in manners which vertically bracket the planes of the upper and lower flanges in an associated beam, results in the moment connection of this invention robustly resisting the potentially damaging condition of prying in response to large moment loads.

Accordingly, while a unique halo-spider nodal connection, full-moment in nature, has been described herein, and certain variations and modifications illustrated and/or suggested, it is appreciated that other variations and modifications may be made without departing from the spirit of the invention.

I claim:

1. A solely gravity-established, full-moment, column/beam nodal connection in a building frame comprising an upright, elongate column having spaced planar faces and pairs of adjacent corners disposed on opposite, lateral sides of each face, plural, elongate standoffs joined to, and extending one each outwardly from each of, said corners at a selected, common elevation located along the length of said column, each pair of adjacent standoffs that extend from a pair of adjacent column corners defining a downwardly and inwardly tapered female reception bearing-interface socket, a halo collar including, for each said female reception bearing-interface socket, a matchingly downwardly and inwardly, male-tapered bearing-interface structure which is designed to bottom out in a full-moment-connection manner with the associated female reception bearing-interface structure, said collar being joined to said column through a bottomed-out, full-moment-connection condition existing between said interface structures, and an elongate beam having an end joined to said collar at a location disposed adjacent one of said faces and intermediate one of said pairs of corners, and extending from the collar outwardly away from said column.

2. The connection of claim 1, wherein said halo collar is segmented to include beam-specific beam-end connecting components, which components include said male-tapered bearing-interface structure.

3. The connection of claim 2, wherein each standoff has feet that wrap around a column corner, and that are anchored to a pair of column faces which join one another through that corner.

4. A full-moment, male/female, standoff-collar, column/beam, gravity-urged, bottoming-out style nodal connection in place between at least one beam and a column in a building frame, where the column possesses generally planar faces joined at plural, laterally spaced corners, said connection comprising a collar having corners, and including, and formed by, plural, adjacent beam-end connecting components, one of which is joined to an end in the at least one beam, each said connecting component possessing a pair of vertically spaced transverse elements each including a generally planar expanse which faces, is spaced outwardly from, and is generally parallel-planar with respect to, an associated column face, with each connecting component forming portions of a pair of said corners in the collar in conjunction with a pair of spaced, adjacent, like connecting components which are associated with adjacent column faces, said collar corners being disposed spaced from and adjacent respective ones of the corners in the column, and plural standoff structures joined to and extending outwardly from the corners of the column along extension lines which are non-orthogonal relative to the planes of said planar expanses and the column faces, said standoff structures joining said collar to the column through the corners in the column and the corners in said collar.

5. The connection of claim 4 which further includes tension pre-stress structure interlinking said collar and said standoff structures.

6. The connection of claim 5, wherein the at least one beam takes the form of an I-beam possessing spaced, generally planar flanges, and said pre-stress structure includes nut-and-bolt sets disposed in pairs of associated nuts and bolts adjacent the corners of said collar, and wherein further the nuts and bolts in each pair thereof straddle, and are disposed on the opposite sides of, the planes of the flanges in the at least one beam.

7. The connection of claim 4, wherein each of said connecting components in said collar includes downwardly male-tapered bearing-interface structure, and the standoff structures define, for each connecting component, a downwardly female-tapered socket sized for receiving, complementarily, and with full-moment gravity seating and locking in a bottoming-out manner, the male-tapered bearing-interface structure in the connecting component.

8. The connection of claim 7, wherein the transverse elements in each connecting component include upper and lower, laterally elongate, transverse elements, and which further includes, interconnecting each upper and lower transverse element, an elongate bridging component.

9. The connection of claim 8, wherein each interconnected pair of upper and lower transverse elements and the interconnecting bridging component collectively form a unitary beam-end connecting component.

* * * * *

UNITED STATES PATENT AND TRADEMARK OFFICE

CERTIFICATE OF CORRECTION

PATENT NO. : 7,941,985 B2
APPLICATION NO. : 12/156252
DATED : May 17, 2011
INVENTOR(S) : Robert J. Simmons It is certified that error appears in the above-identified patent and that said Letters Patent is hereby corrected as shown below:

Column 2, line 1, “associated beam” should read --associated column--.

Signed and Sealed this
Thirtieth Day of April, 2013

Teresa Stanek Rea
*Acting Director of the United States Patent and Trademark Office*